US011286819B2

(12) United States Patent
Mareau et al.

(10) Patent No.: US 11,286,819 B2
(45) Date of Patent: Mar. 29, 2022

(54) INTERNALLY COOLED VALVE WITH INERTIAL PUMP

(71) Applicant: FEDERAL-MOGUL VALVETRAIN GMBH, Barsinghausen (DE)

(72) Inventors: Andre Mareau, Strasbourg (FR); Sebastien Poirot, Le Saulcy (FR); Frederic Colin, Wildersbach (FR)

(73) Assignee: Federal-Mogul Valvetrain GmbH, Barsinghausen (DE)

( * ) Notice: Subject to any disclaimer, the term of this patent is extended or adjusted under 35 U.S.C. 154(b) by 0 days.

(21) Appl. No.: 16/980,656

(22) PCT Filed: Mar. 14, 2018

(86) PCT No.: PCT/EP2018/056388

§ 371 (c)(1),
(2) Date: Sep. 14, 2020

(87) PCT Pub. No.: WO2019/174724

PCT Pub. Date: Sep. 19, 2019

(65) Prior Publication Data

US 2021/0025297 A1 Jan. 28, 2021

(51) Int. Cl.
*F01L 3/14* (2006.01)

(52) U.S. Cl.
CPC ..... *F01L 3/14* (2013.01); *F01L 2810/01* (2013.01)

(58) Field of Classification Search
CPC ..... F01L 3/14; F01L 2810/01
USPC ..... 123/41.16
See application file for complete search history.

(56) References Cited

U.S. PATENT DOCUMENTS

| | | | | | |
|---|---|---|---|---|---|
| 698,474 | A * | 4/1902 | Ebbs | F01L 3/18 | 123/41.41 |
| 2,188,248 | A * | 1/1940 | Possenti | F01L 3/16 | 123/41.16 |
| 2,984,227 | A * | 5/1961 | Mikina | F01L 1/22 | 123/90.53 |
| 3,871,339 | A * | 3/1975 | Kuhn | F01L 3/18 | 123/41.41 |
| 3,945,356 | A * | 3/1976 | Kuhn | F01L 3/18 | 123/41.41 |
| 4,187,807 | A * | 2/1980 | Cemenska | F01L 3/18 | 123/188.2 |

(Continued)

FOREIGN PATENT DOCUMENTS

| | | | | |
|---|---|---|---|---|
| DE | 843039 C | * | 7/1952 | F01L 3/14 |
| DE | 843039 C | | 7/1952 | |
| DE | 910492 C | | 5/1954 | |

(Continued)

OTHER PUBLICATIONS

International Search Report, dated Dec. 4, 2018 (PCT/EP2018/056388).

*Primary Examiner* — Hung Q Nguyen
*Assistant Examiner* — Anthony Donald Taylor, Jr.
(74) *Attorney, Agent, or Firm* — Robert L. Stearns; Dickinson Wright, PLLC

(57) ABSTRACT

A internally cooled poppet valve (2) with inertial pump (4) includes a valve body (20) having a valve head (22) and a valve stem (24). The valve body (20) has a closed cavity (26), in which a cooling fluid (28) is disposed. The inertial pump (4) is disposed in the valve body (20), which moves the cooling fluid (28) in the cavity during operation.

12 Claims, 10 Drawing Sheets

(56) References Cited

U.S. PATENT DOCUMENTS

| | | | | | |
|---|---|---|---|---|---|
| 8,479,692 | B2 * | 7/2013 | Ishimitsu | ..... | F01L 3/18<br>123/41.41 |

FOREIGN PATENT DOCUMENTS

| | | | | | |
|---|---|---|---|---|---|
| DE | 2727006 | A1 | | 12/1978 | |
| DE | 29624637 | U1 | | 3/2006 | |
| JP | S58185917 | A | * | 10/1983 | ..... F01L 3/14 |
| JP | S58185917 | A | | 10/1983 | |

* cited by examiner

Fig. 8A
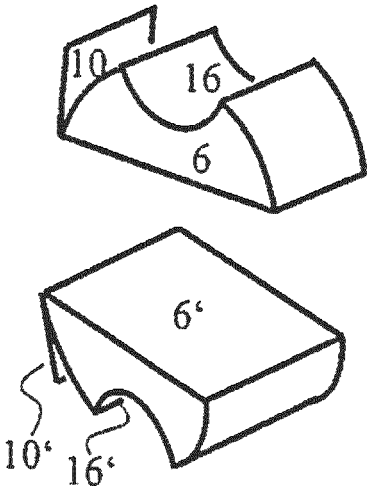
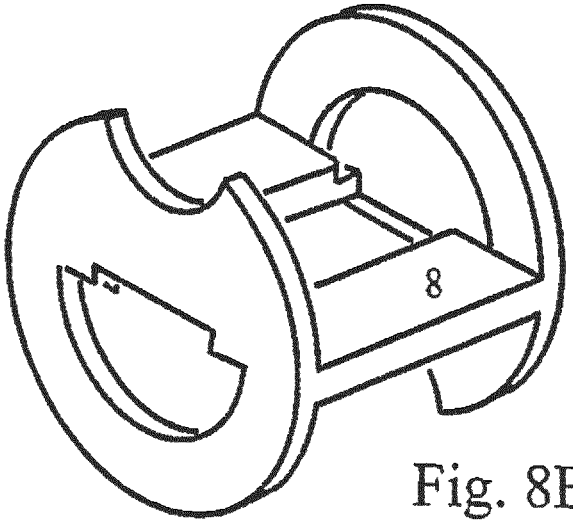
Fig. 8B
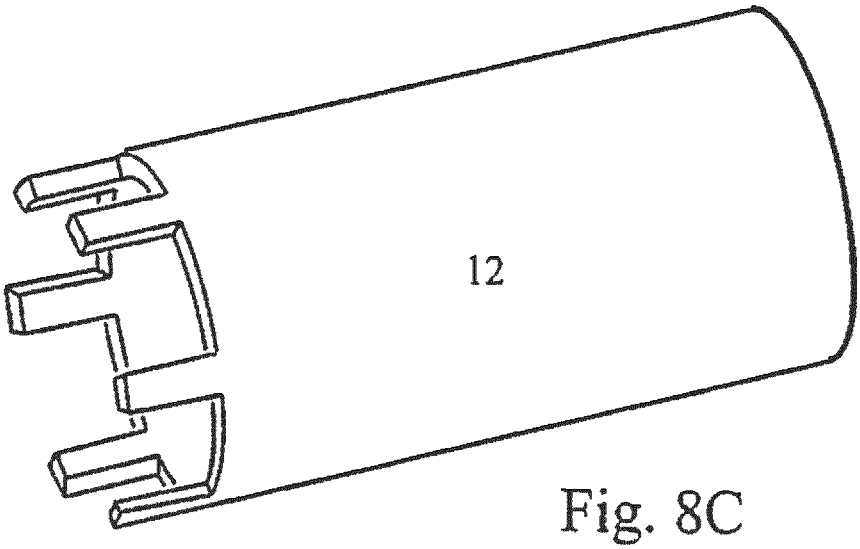
Fig. 8C
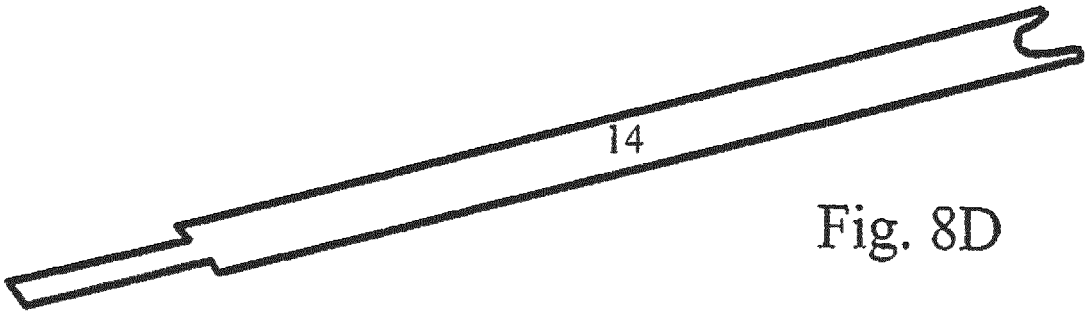
Fig. 8D

INTERNALLY COOLED VALVE WITH INERTIAL PUMP

The present invention relates to an internally cooled valve with an inertial pump which pumps a cooling fluid to and fro between a stem section and a head section.

Hitherto, inertial pumps have only been known as shaking or agitating pumps. Shaking pumps are substantially formed by a check valve which is attached at one end of a hose which is dipped in a liquid and moved rapidly to and fro in the axial direction. The inertia of the liquid drives this during a forward or dipping movement through the valve into the hose and the check valve prevents the liquid from flowing back during a backward movement. These pumps are used to refill fuels using hoses according to the principle of the lever or siphon without anybody needing to suck the fuel, for example, with the mouth. However, these pumps are not suitable for pumping a fluid in a hose closed to form a circuit.

In the area of internal combustion engines it is desirable to improve the cooling properties of internally cooled valves.

This problem is solved by an internally cooled poppet valve with inertial pump having the features of claim 1, wherein preferred embodiments are described in the dependent claims.

The present invention relates to an internally cooled poppet valve with inertial pump. The valve comprises a valve body having a valve head and a valve stem. The valve body comprises a closed or enclosed cavity, in which a cooling fluid is disposed. An inertial pump is further disposed in the valve body or in the cavity, which moves the cooling fluid in the cavity during operation of the valve or pumps it through the cavity. The inertial pump is thereby operated by a movement of the poppet valve in the axial direction, wherein the pump is moved by a momentum transfer between valve body and pump. In the case of the inertial pump, it is not necessary that separate elements are provided in order to supply the inertial pump with energy. However, the inertial pump must be matched to a working path of the valve. The use in an engine which operates the valve with a too-small working path can have the result that the inertial pump completely fails. In addition to the quite different parameters, when designing the valve therefore the valve stroke must be known as the most important design parameter.

In one embodiment of the internally cooled poppet valve with inertial pump, the cavity forms at least one closed circuit. Here the cavity should form a doubly interconnected space in which the cooling fluid is pumped in a circuit. The expression cooling fluid here designates a coolant which reaches a fluid state at least at the operating temperature of the valve. It can also comprise sodium which is solid under normal conditions or at room temperature.

In another embodiment of the internally cooled poppet valve with inertial pump, the cooling fluid is compressible. Here the cooling fluid is a gaseous and compressible cooling fluid under operating conditions of the valve.

In an additional embodiment, the cooling fluid is an incompressible or liquid cooling fluid, Here for example, liquid sodium at an operating temperature is used. Other metals having a low melting point and a high conductivity can also be used.

Another embodiment of the internally cooled poppet valve with inertial pump is designed so that the inertial pump comprises at least one pump body which has a higher density than a density of the cooling fluid. It is important here that the pump body has a significantly higher density than the cooling fluid or cooling fluid since it would otherwise float or be suspended in this and would not be able to move this through its momentum. The inertial pump of the invention is based on the fact that a pump body that has a higher density than the fluid to be conveyed can push this in front of it and can also transport a quantity of fluid corresponding to its volume against a momentum direction.

An additional embodiment of the present invention is based on the fact that the inertial pump of the internally cooled poppet valve further comprises at least one control body which controls an intake or discharge of cooling fluid to or from the pump body. The control body preferably also has a density which is higher than the density of the coolant or cooling fluid. The control body can be operated floating in the cooling fluid or dipped in the cooling fluid. The control body has the task of controlling whether the pump body executes an upward pumping, downward pumping or an empty movement. The control body thereby cooperates with the pump body as is fundamentally known from the steam slider of a steam machine and ensures that the cooling fluid is only pumped in one direction through a circular cavity. The control body can be connected to the pump body but can be arranged completely independently of this freely movably in the cavity.

The terms pump body and control body here stand for movable components of the inertial pump. The inertial pump can additionally also comprise a pump housing in which the pump body and/or the control body can move. However, it is also possible that the valve body serves as an inertial pump housing and the pump body and/or the control body can move in corresponding recesses in the valve body.

In a further embodiment of the internally cooled poppet valve with inertial pump, the at least one pump body is disposed in the at least one control body. Here the control body can be designed to be tubular (with end faces) and the pump body can be designed to be cylindrical. The pump body can then be arranged in the control body. A housing can have the form of a cylindrical bore. Openings in the control body and the housing are then used to control whether and when the pump body actually conveys the cooling fluid.

In another exemplary embodiment of the internally cooled poppet valve with inertial pump, a frictional engagement element is further disposed on the inertial pump which places the at least one pump body in frictional engagement with the at least one control body. As a result, the pump body and the control body move jointly within their working strokes. The control body is provided with a smaller working stroke than the pump body. In this case, pump body and control body move together until the smaller working stroke of the control body is used up and the pump body moves further against the friction with respect to the control body.

Another embodiment of the internally cooled poppet valve with inertial pump comprises a pump body having a greater working stroke than a working stroke of the at least one control body. It can be advantageous if the working strokes of the at least one pump body and the at least one control body are each smaller than a working stroke of the poppet valve during operation. This is not necessary however since merely during the working stroke of the valve, in each case a sufficiently large momentum must be transferred to the pump body or bodies and the control body or bodies that the pump and control bodies can pump the coolant through the coolant circuit during an open or closed phase of the valve. It can therefore be necessary here to also know the precise working stroke of the valve in order to be able to suitably design the inertial pump. Further important design parameters of the valve are in addition the opening time as well as the time during which the valve is open during operation. In the case of a double inertial pump, this must be designed so that the pumping process can execute a pumping process during the opening time, i.e. the time during which the valve stays in the open position. It is also possible to design a double inertial pump with different individual pumps.

An additional embodiment of the internally cooled poppet valve with inertial pump further comprises at least one valve or check valve which is disposed on the valve body and/or the at least one pump body and/or the at least one control body. The valve or valves can also be disposed on a pump housing which however is also seen as part of the valve body. The design forms a rather classical pump in which one, two or more check valves prevent cooling fluid from flowing back contrary to the pump direction. It can thus be ensured that the cooling circuit only has cooling fluid flowing through it in one direction. An additional advantage consists in that in this design the control body can be completely dispensed with, a check valve can be arranged in each of the cooling fluid path and the pump body and there is no need for the control body. A disadvantage can . . .

Another embodiment of the internally cooled poppet valve with inertial pump comprises a valve body which has a bore in the stem, wherein a guide body is inserted in the bore or wherein two axial openings run in the valve body from the valve head in the direction of the valve stem end, wherein the axial openings are interconnected at their ends. In these embodiments, a cooling channel is formed from the valve head as far as a valve stem end and back again, in which a cooling fluid can flow from the valve head through the stem in the direction of the stem end and on a different path back again to the valve head. Here the cooling fluid is specifically guided on two different paths to the stem end and back again to the valve head. In this embodiment, it can be ensured that a cooling fluid flowing back from the cooled valve stem into the valve head does not mix with a cooling fluid which has a higher temperature. As a result, the cooling capacity of the cooling fluid or the internal cooling should be improved.

An additional embodiment of the internally cooled poppet valve has an inertial pump comprising a first and a second pump body and one or two control bodies, wherein a first pump body executes a working stroke during a valve closing process and the second pump body executes a working stroke during a valve opening process. In this embodiment, two inertial pumps are provided which each pump the cooling fluid in a different process. The first pump body can pump the cooling fluid through the cooling channel during a valve opening whereas the second pump body conveys or pumps the cooling fluid through the cooling channel during a valve closing process. Here in a four-stroke motor two pump processes are executed in four strokes or in two crankshaft revolutions or in one camshaft revolution. Here the primary aim is to achieve the most uniform possible movement of the cooling fluid through the cooling channel.

In another embodiment of the internally cooled poppet valve with inertial pump, the at least one pump body forms a circular cylinder or a semi-circular cylinder and is further provided with an axial recess and the at least one control body is coil-shaped or half-coil shaped. Coil-shaped means here substantially in the form of a tube or semi-tubular central section which is closed on both sides by end disks having a substantially larger diameter. Half-coil-shaped means substantially the shape of a coil-shaped form divided in the axial direction. The pump body here lies between the end disks of the coil or half-coil shape. The end disks can be provided with openings which align with a longitudinal recess of the pump body or are offset with respect to this. If one opening of the end disk is aligned with a longitudinal recess of the pump body, this connection is always open on this side. If one opening of the end disk is offset with respect to a longitudinal recess of the pump body, this connection is only open on this side when the pump body does not abut against this end disk. The inertial pump with control body is only designed so that during an opening or closing process the pump body closes a passage and can thus execute a pumping or working stroke and in the case of the appurtenant counter movement, the cooling fluid can flow through the pump body and the control body. Thus, during the to and fro movement of the valve, the cooling fluid can always only be conveyed in one direction and flow through the cooling circuit can only take place in one direction.

Another embodiment of the internally cooled poppet valve with inertial pump is designed in two parts, wherein a valve body is closed from below with a valve base, wherein the valve base is provided with an inertial pump housing, a circumferential cooling path and radial bores, which connect the inertial pump housing to the circumferential cooling path. The circumferential cooling path is in this case disposed in the vicinity of a valve seat or the edge of the valve disk in order to cool a sealing surface of the poppet valve.

The radial bores can be arranged close to one another, wherein a separating element is preferably inserted between the radial bores so that a cooling fluid can flow once at the edge of the valve disk in the clockwise and anticlockwise direction in this and around this.

The radial bores can also be arranged diametrically opposite to one another, wherein no separating element is required. In this embodiment a cooling fluid flows simultaneously in the clockwise and anticlockwise direction 180° along the edge or the valve seat of the valve. This two-part cooling circuit additionally has the advantage that no large temperature differences occur due to the coolant since the coolant flows in opposite directions on both sides from one side to the other of the valve disk. Here a slight temperature gradient is produced from one side to the other, whereby a strong temperature gradient such as occurs with the aforesaid version at the separating element can be avoided.

The present invention is illustrated hereinafter with reference to various embodiments of inertial pumps and a poppet valve with an integrated inertial pump. The objects shown in the figures are not to scale and only schematically depict the invention.

FIGS. 8A to 8H show perspective views of individual parts of a double-acting inertial pump and a partial sectional view of a poppet valve with a corresponding inertial pump.

In the following, the same or similar reference numbers are used both in the description and in the figures to refer to the same or similar components and elements.

FIGS. 1A to 1D show perspective views of a pump body and a control body as well as the interaction thereof.

An inertial pump is described hereinafter which works in a closed circuit which is subjected to a periodic to and fro movement. Since it is assumed that the acceleration and inertial forces occur at the beginning and end of an opening or closure of a valve and a coolant should be pumped in a closed circuit, it is very important that the pump body or the control body has a density which differs as strongly possible from the density of the coolant to be pumped. If this were not the case, the pump body would merely float or be suspended in the coolant and not be able to react to the acceleration forces at the beginning and end of an opening or closing process.

Figure 1A:
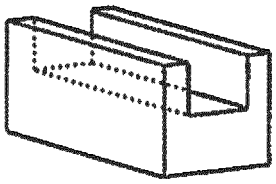
FIGS. 1A to 1D show perspective views of a pump body and a control body as well as their interaction.

FIG. 1A shows a pump body 6 in a rectangular design which has a recess running in the longitudinal direction on one side. The mass of the pump body 6 should be selected to be as high as possible and therefore a material which is as dense and stable as possible should be used. For example, tungsten, osmium and iridium alloys would have ideal properties which are also capable of reliably pumping metallic coolants such as sodium. The higher the mass and the density difference from the coolant, the higher is the pump capacity which can be achieved with the inertial pump. Located in the pump body on one side is a longitudinal recess through which a coolant can flow when this is not closed on a front or rear side.

Figure 1B:
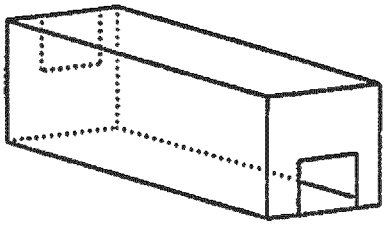

FIG. 1B shows a control body which has the form of a hollow cuboid having an opening arranged in the faces thereof, once at the top and once at the bottom. The control body 8 can also be open laterally on one side or both sides so that the pump body 6 can be inserted more easily into the control body 8. The front or the rear opening of the control body 8 is in alignment with the longitudinal recess of the pump body 6 whereas the other opening does not overlap with the longitudinal recess of the pump body. Without an inserted pump body 6, a cooling fluid can flow through the front opening [through] the cavity and the rear opening through the control body.

Figure 1C:
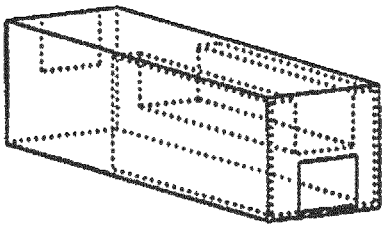

FIG. 1C shows the pump body 8 which is inserted in the control body 8 and abuts against a front wall of the control body 8. The longitudinal recess of the pump body is concealed by the front wall of the control body and the front opening of the control body 8 is closed by the pump body. In this configuration, the pump body 6 when it moves forwards or backwards together with the control body 8 can push or pump a fluid in front of it.

Figure 1D:
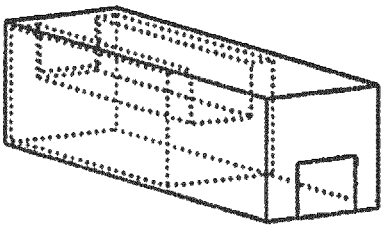

FIG. 1D shows the pump body 8 which is inserted in the control body 8 and abuts against a rear wall of the control body 8. The longitudinal recess of the pump body is aligned with the rear opening in the rear wall of the control body. In this configuration a coolant can enter into the control body at the front through the lower opening, flow upwards to and through the longitudinal recess of the pump body 6 and emerge again through the rear upper opening in the rear wall of the control body. When the pump body 6 is moved forwards and backwards together with the control body 8, the cooling fluid can flow through the pump and control body and is not moved or pumped through the pump or control body.

FIGS. 2A to 2D show in sectional views the most important components of a simple inertial pump and how these are combined.

Figure 2A:
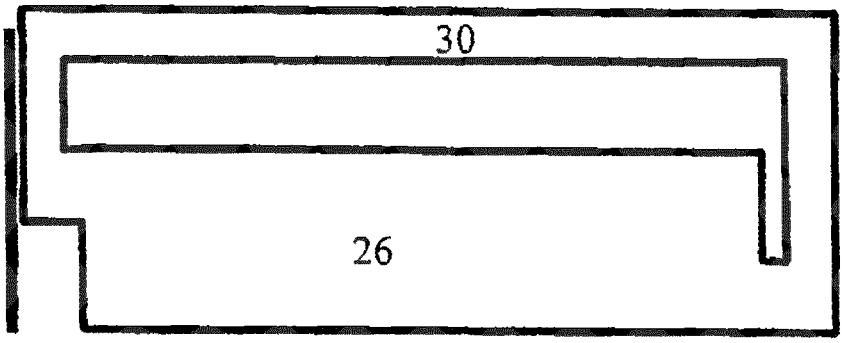
FIGS. 2A to 2D show in sectional views the most important components of a simple inertial pump and how these are composed.

FIG. 2*a* shows a cavity which serves as pump housing and as cooling channel or cooling fluid circuit. Two dashes here represent the two end points of a movement of the valve, FIGS. 2A to 2F are shown from the view of the valve.

The closed circuit 30 comprises a wider section which is intended to receive the control body and the pump body. The cooling fluid can be pumped in the cooling circuit 30 in the circuit. The cavity 26 also forms a type of pump housing in which the control body 8 and the pump body 6 move.

Figure 2B:
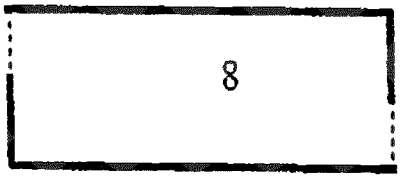

FIG. 2B shows the control body 8 from FIG. 1B in a lateral sectional view, the openings are shown by dashed sections.

Figure 2C:
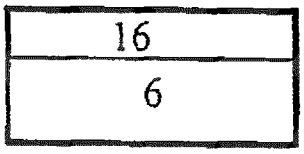

FIG. 2C shows the pump body 6 of FIG. 1A, also in a lateral sectional view. The longitudinal or axial recess is located on the upper side of the pump body 6.

Figure 2D:
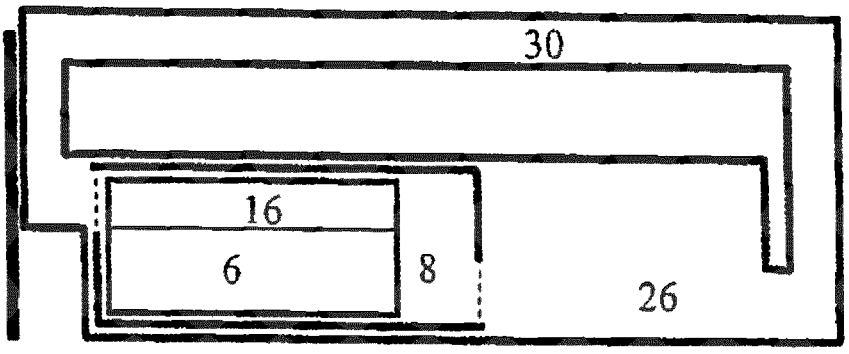

FIG. 2D shows the components of FIGS. 2A to 2C which are combined to form an inertial pump with a closed cooling circuit 30. Located in the cavity 26 is a control body 8 in which the pump body 6 is again received. The position of the pump body 6 in the control body has the result that the pump body allows or can allow cooling liquid to pass through the axial recess 16. In this state, the cooling fluid not shown can flow freely through the cooling circuit 30. The cooling fluid is not shown since it fills the entire cavity 26 or the entire cooling circuit 30.

FIGS. 3A to 3L illustrate in respective sectional views the mode of operation of the inertial pump from FIGS. 2A to 2D. FIGS. 3A to 3F describe a charging or extraction process whilst FIGS. 3G to 3L show a working or pumping process.

Figure 3A:
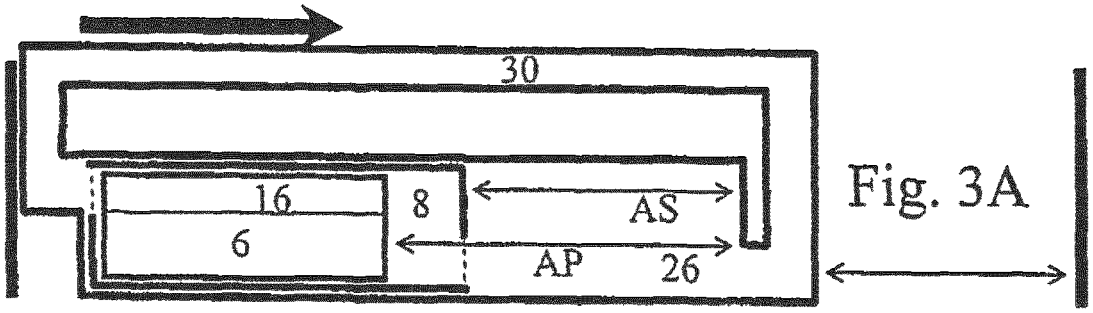
FIGS. 3A to 3L illustrate in respective sectional views the operating mode of the inertial pump in FIGS. 2A to 2D.

In FIG. 3A the inertial pump from FIG. 2D is located at the beginning of a closing movement of a valve and the entire inertial pump 2 with the cooling circuit 30, the control body 8 and the pump body 6 begin to move to the right. The pump body 6 and the control body 8 are arranged as shown in FIG. 1D. The cooling fluid does not move here and both the control body 8 and the pump body 6 abut against the left side of the cavity 26 and thereby receive a momentum or kinetic energy, In FIG. 3A the double arrow AV designates the working stroke of the valve. The double arrow As designates the working stroke of the control body 8 and the double arrow AP designates the working stroke of the pump body.

Figure 3B:
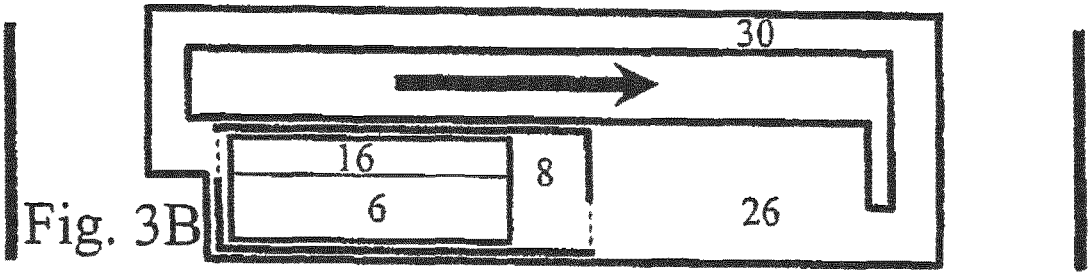

In FIG. 3B the inertial pump from FIG. 2D is located in the middle of a closing movement of the valve and the entire inertial pump 2 with the cooling circuit 30, the control body 8 and the pump body 6 reach their maximum speed or their maximum momentum. The cooling fluid still does not move since it still fills the entire cooling circuit 30 according to the principle of communicating pipes.

Figure 3C:
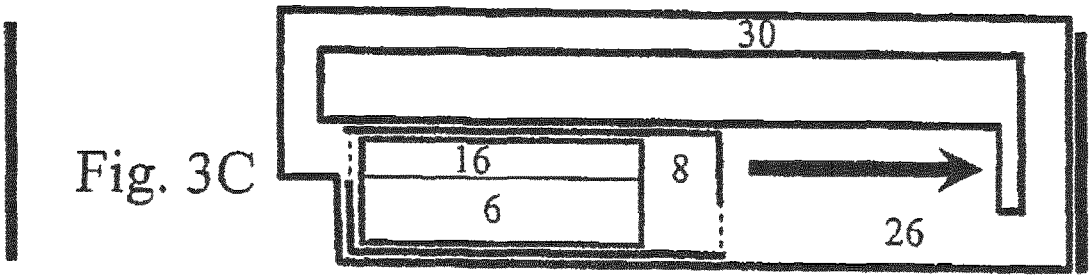

In FIG. 3C the closing movement of the valve has ended and the components of the inertial pump 2 have not yet moved relative to the valve or the cavity 26. The cavity 26 is abruptly stopped when an edge of the poppet valve impinges on the valve seat.

Figure 3D:
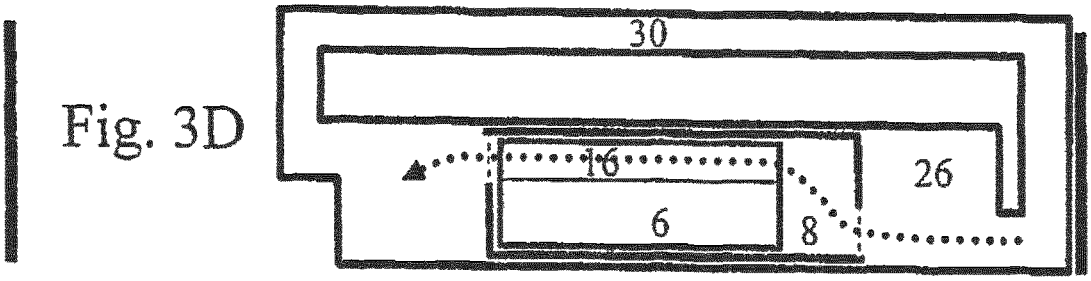

In FIG. 3D the closing movement of the valve has ended and the cavity 26 is at rest. The pump body 6 and the control body 8 remain according to Newton in the state of their motion and move further to the right. During this movement the cooling fluid can flow through the openings in the control body 6 and the axial recess 16 in the pump body 6 through these components and the cooling fluid is substantially not conveyed through the cooling circuit. However, the movement of the control body 8 and the pump body 6 is only possible when the density of these components differs as strongly as possible from the density of the cooling fluid since otherwise the control body 8 and the pump body 6 would be suspended in the cooling fluid and would have no cause at all to move towards the cavity. The cooling fluid primarily moves as indicated by the dotted arrow.

Figure 3E:
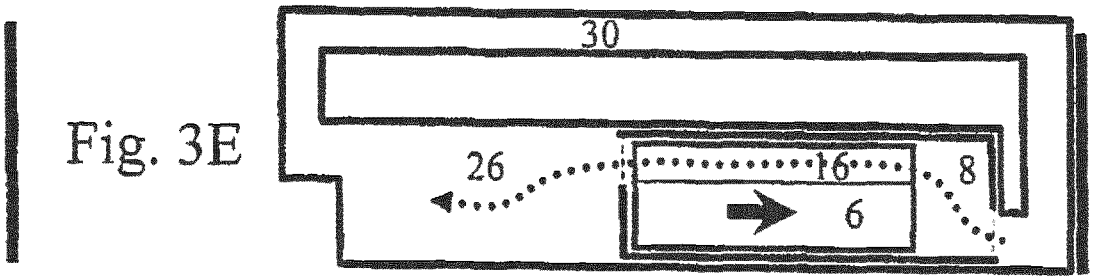

FIG. 3E continues the movement of the pump body 6 and the control body 8 wherein the control body has arrived at the right end of the cavity 26. With the contact of the control body at the right end of the cavity 26 its movement is at an end. In FIG. 3E the cooling fluid can still flow through the control body 8 and the pump body in particular through the axial recess 16 of the pump body 6. The pump body 6 remains in the state of its movement and moves further to the right. During this movement the cooling fluid can flow through the openings in the control body 8 and the axial recess 16 in the pump body 6 through these components. Starting from FIG. 3E, only the pump body 6 can move further since the control body 8 has already reached its end position. The cooling fluid moves principally as indicated by the dotted arrow.

Figure 3F:
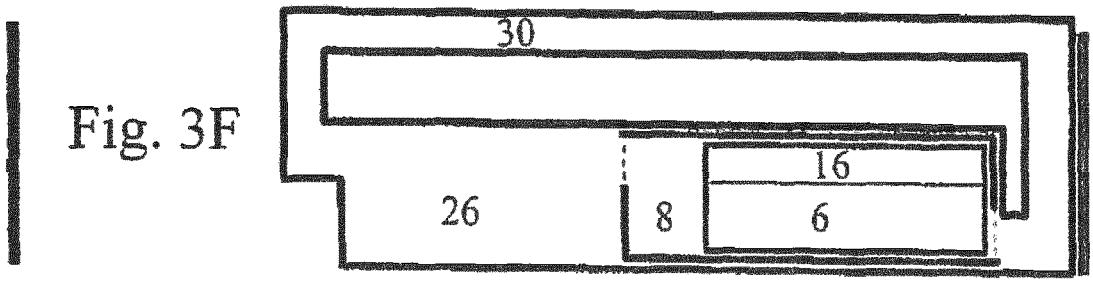

FIG. 3F shows the end position of the closing movement of the valve and the inertial pump 2. The cooling circuit 30 with the cavity 26 is located in a far right position. The control body 8 is located on the far right at the end of the cavity 26. The pump body 6 has also adopted its end position on the far right. The axial recess 16 of the pump body 6 is offset with respect to the right opening of the control body so that the pump body 6 in the right end position closes the right opening of the control body 8. The pump body 6 and the control body 8 are arranged as shown in FIG. 1C. The cooling circuit 30 is interrupted and the cooling fluid rests in the cooling circuit 30.

The following FIGS. 3G to 3L describe a working or pumping process of the inertial pump.

Figure 3G:
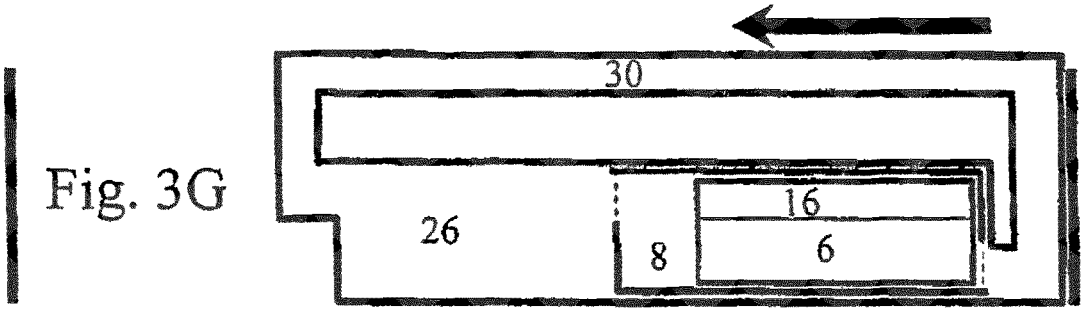

In FIG. 3G the inertial pump from FIG. 2D is located at the beginning of an opening movement of a valve and the entire inertial pump 2 with the cooling circuit 30, the control body 8 and the pump body 6 begin to move to the left. The pump body 6 and the control body 8 are arranged as shown in FIG. 1C wherein the cooling circuit is interrupted. The cooling fluid does not move here and both the control body 8 and the pump body 6 abut against the right side of the cavity 26 and thereby receive a momentum or kinetic energy.

Figure 3H:
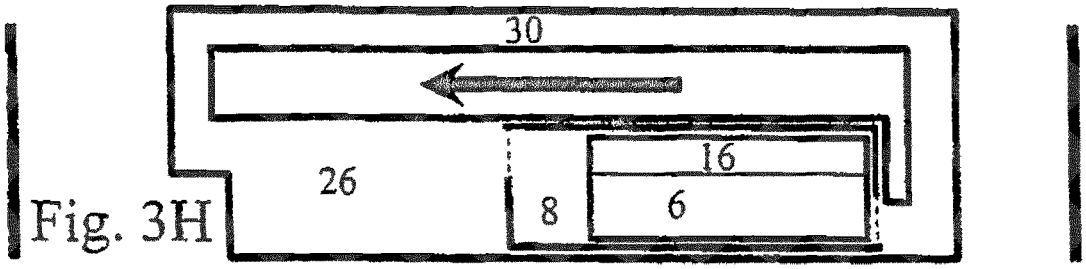

In FIG. 3H the inertial pump is located in the middle of an opening movement of the valve and the entire inertial pump 2 with the cooling circuit 30, the control body 8 and the pump body 6 reach their maximum speed or their maximum momentum. The cooling fluid still does not move since the pump body 6 and the control body 8 still interrupt the entire cooling circuit 30.

Figure 3I:
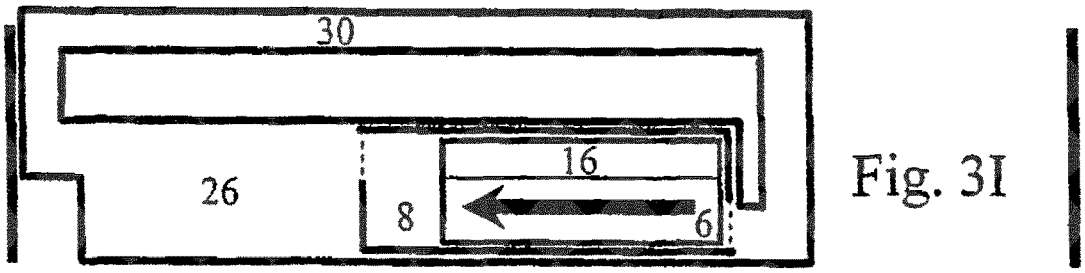

In FIG. 3I the closing movement of the valve has ended and the components of the inertial pump 2, i.e. the pump body 6 and the control body 8 have not yet moved relative to the valve or the cavity 26. The cavity 26 is abruptly stopped at the end of the opening movement when the cam reaches its highest position.

Figure 3J:
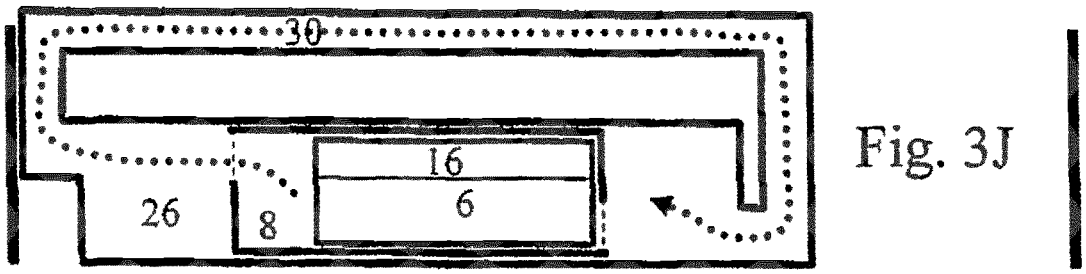

In FIG. 3J the opening movement of the valve has ended and the cavity 26 is at rest. The pump body 6 and the control body 8 remain according to Newton in the state of their motion and move further to the left as a result of their momentum or their inertia. The left opening of the control body 8 is closed by the pump body 6 and as a result of the movement, the pump body 6 together with the control body 8 can pump the cooling fluid through the cooling circuit. The movement of the control body 8 and the pump body 6 is only possible here when the density of these components differs as strongly as possible from the density of the cooling fluid. The pump capacity depends on the valve speed, the density difference between the cooling medium and the pump or control body 6, 8 and on the total mass of the cooling fluid and the mass of the pump body 6. The control body 8 and the pump body 6 push the cooling fluid approximately along the dotted arrow in front of them through the cooling circuit 30.

Figure 3K:
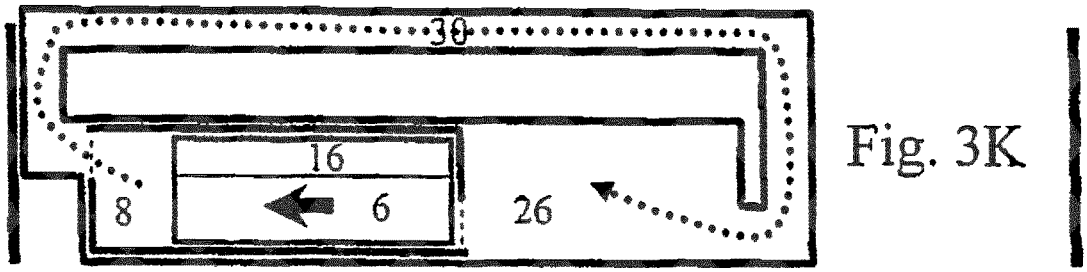

FIG. 3K continues the movement of the pump body 6 and the control body 8 wherein the control body has arrived at the left end of the cavity 26. With the contact of the control body 8 at the left end of the cavity 26 its movement is at an end. In FIG. 3K the cooling fluid cannot yet flow through the control body 8 and the pump body in particular through the axial recess 16 of the pump body 6. After the movement of the control body 8 in FIG. 3K ends, the pump body 6 moves further but only in the control body 8.

Figure 3L:
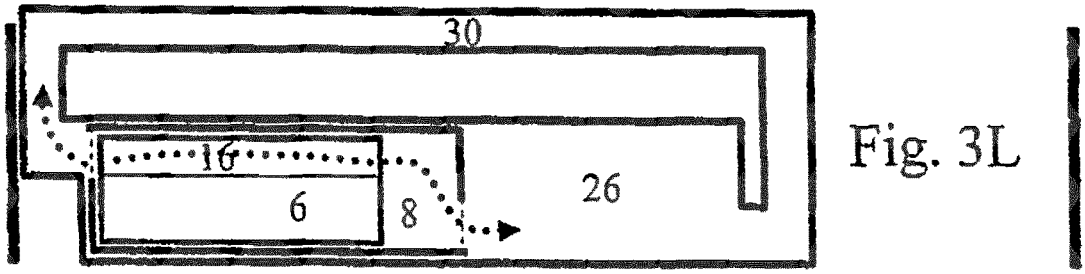

FIG. 3L shows the end position of the opening movement of the valve and the initial position of the inertial pump 2 as in FIG. 3A. The pump body 6 and the control body 8 are located on the far right in the cavity 26. As a result of the last part of the movement, the pump body 6 has released the right opening in the control body again and the cooling fluid can flow further through the cooling circuit. The work cycle of the inertial pump is thus ended. The control body 8 is again located at the beginning on the far left at the end of the cavity 26. The pump body 6 has also adopted its end position on the far left. Through the axial recess 16 of the pump body 6 and the spaced-apart right ends, cooling fluid can flow through the axial recess 16 and the right opening of the control body. The pump body 6 and the control body 8 are again arranged as shown in FIG. 1D. The cooling circuit 30 is continuous and the cooling fluid can flow further through the cooling circuit according to its inertia.

The inertial pump in FIGS. 3A to 3L is a pump which only executes a work or pump cycle or process in one direction whereas the pump does not execute any pumping process in the other direction and additionally opens the cooling circuit 30 and thus enables a free flow of cooling fluid in the cooling circuit 30.

Figure 4A:
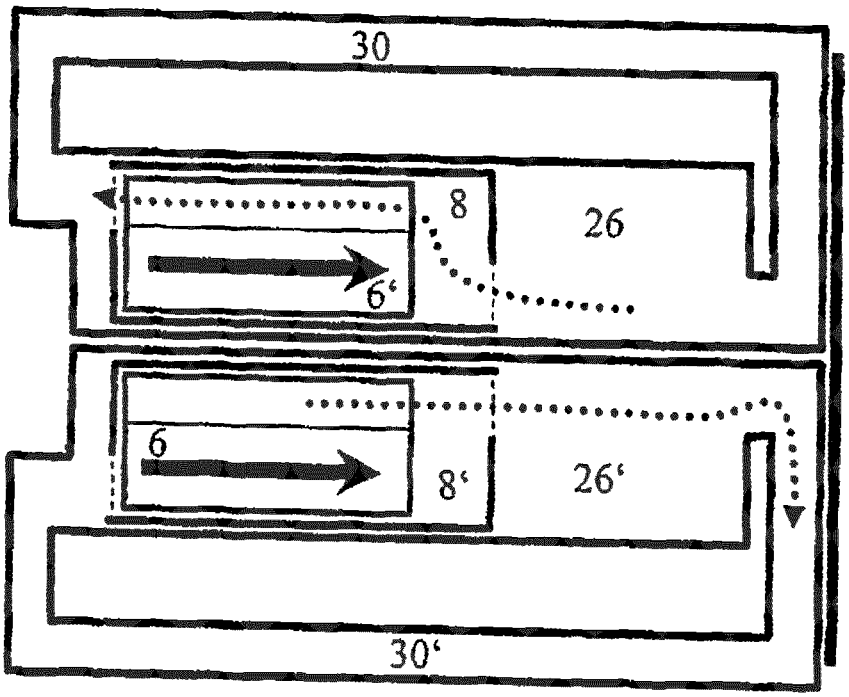
FIGS. 4A and 4B show two inertial pumps operating with respect to one another, whose design corresponds to that of FIG. 2A.
Figure 4B:
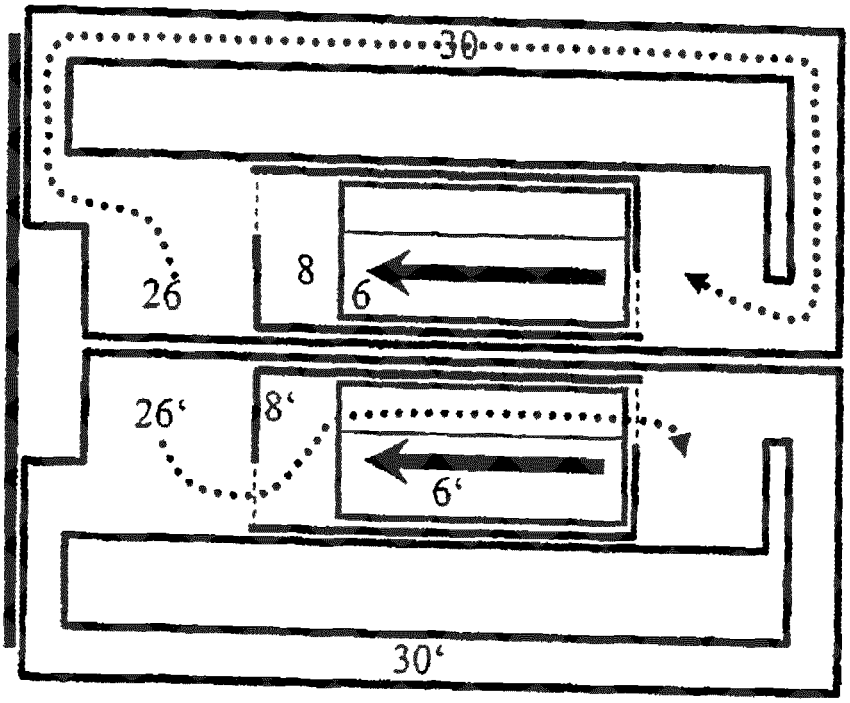

FIGS. 4A and 4B show two inertial pumps working against one another whose design substantially corresponds to that of FIG. 2D. The double pump is composed of two pumps which appear symmetrical at first glance. The upper or first inertial pump with the cavity 26, the cooling circuit 30, the control body 8 and the pump body 6 corresponds to the pump as shown in FIG. 3D.

Furthermore, the operation of the upper first pump precisely corresponds to the steps shown in FIGS. 3A to 3L. The second lower inertial pump 2' is approximately symmetrical to the first upper inertial pump 2. Only the pump body 6' was not mirrored and is aligned precisely as that of the first upper inertial pump. As a result of the slightly different structure, the pump and charging or extraction cycles are each transposed in the two pumps. FIG. 4A shows the upper pump in a charging process which corresponds to that shown in FIG. 3D, wherein the pump body 6 and the control body 8 move and a cooling fluid can thereby flow through these components. The second lower pump in FIG. 4A on the other hand is located in a pumping process which corresponds to that shown in FIG. 3K, wherein a passage through the pump body 6 and the control body 8 is closed and the pump body 6 and the control body 8 pump the cooling fluid through the lower cooling circuit 30' during their movement.

FIG. 4B shows the converse case where the upper first inertial pump 2 pumps the cooling fluid through the first cooling circuit whilst the lower second inertial pump 2' returns into the right position without pumping. Here the upper inertial pump is in the working step shown in FIG. 3K whilst the lower second lower pump in FIG. 4A is located in a process in which the second pump body 6' and the second control body 6' execute an extraction or charging step.

The double pump simply comprises two pumps which alternately pump a cooling fluid through a separate cooling circuit when opening the valve and when closing the valve.

Figure 5A:
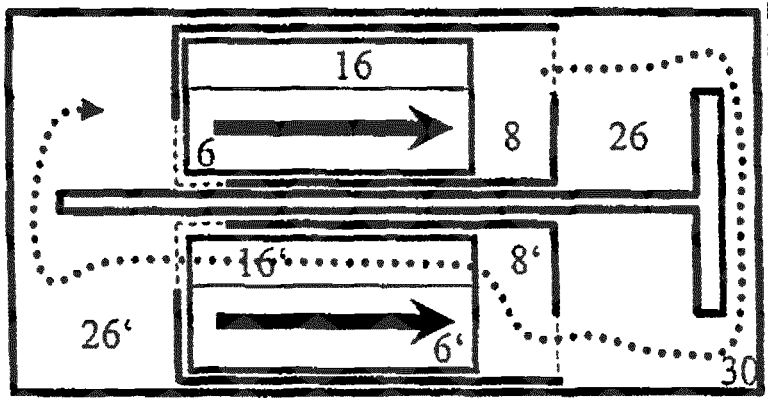
FIGS. 5A and 5B show two cooperating inertial pumps which work together in a cooling circuit.
Figure 5B:
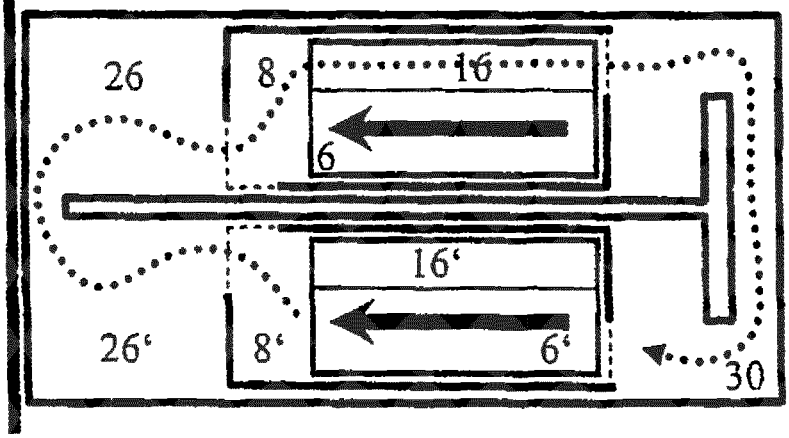

FIGS. 5A and 5B show a further development of the double pump from FIGS. 4A and 4B. The upper first and the lower second inertial pump 4, 4' work in a common cooling circuit. Furthermore, the control bodies 8, 8' are slightly modified in order to enable a shorter overall length or a smaller overall height. The control bodies 8, 8' also have a lateral opening in order to enable a direct straight connection of the first cavity 26 with the second cavity 26' instead of a u-shaped connection. As a result, the entire overall height of the previously required u-shaped connection can be saved. In FIGS. 5A and 5B the inertial pumps correspond to those as known from FIGS. 4A and 4B apart from the previously described more compact design. The unique feature of the inertial pumps to provide an open connection during a charging cycle enables one pump to pump a cooling fluid through the other pump. Here, compared to the pump as described in FIGS. 1A to 4B, a significantly higher pump capacity is achieved. The double pump according to FIGS. 5A and 5B enables a cooling fluid to be pumped twice as efficiently in a valve stem as would be possible with the pump from FIG. 4A. The two pumps cooperate in FIGS. 5A and 5B, in a single stroke they can convey a pump volume twice as far as would be possible with a single pump. The pumps of FIG. 4 certainly pump the same volume but through two different channels which in turn drastically reduces the cooling capacity. Instead of the U-connection on the right-hand side, a cooling channel can be connected here which extends into a valve stem in order to achieve improved cooling.

Figure 6:
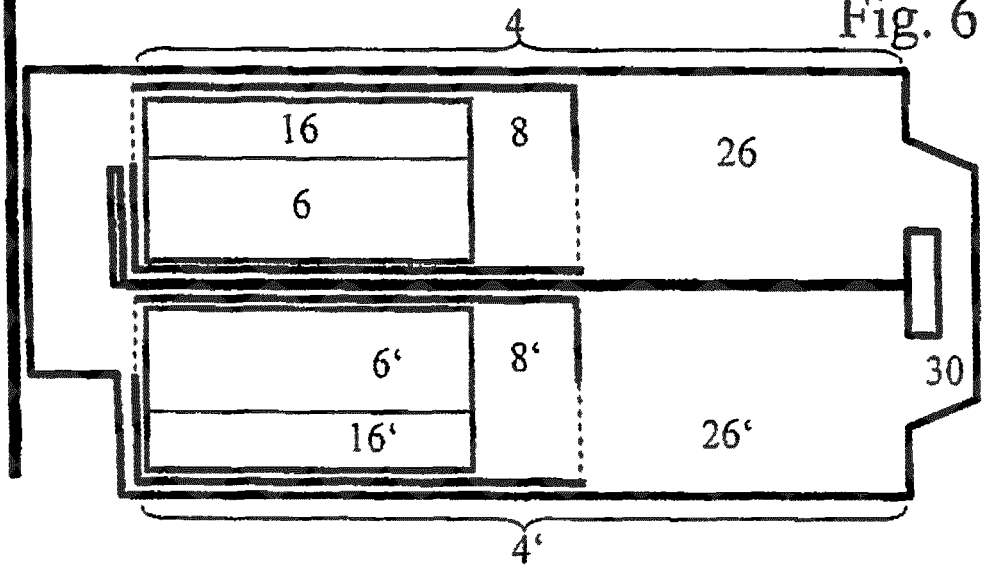
FIG. 6 shows an inertial pump combination which operates in a cooling circuit.
Figure 7A:
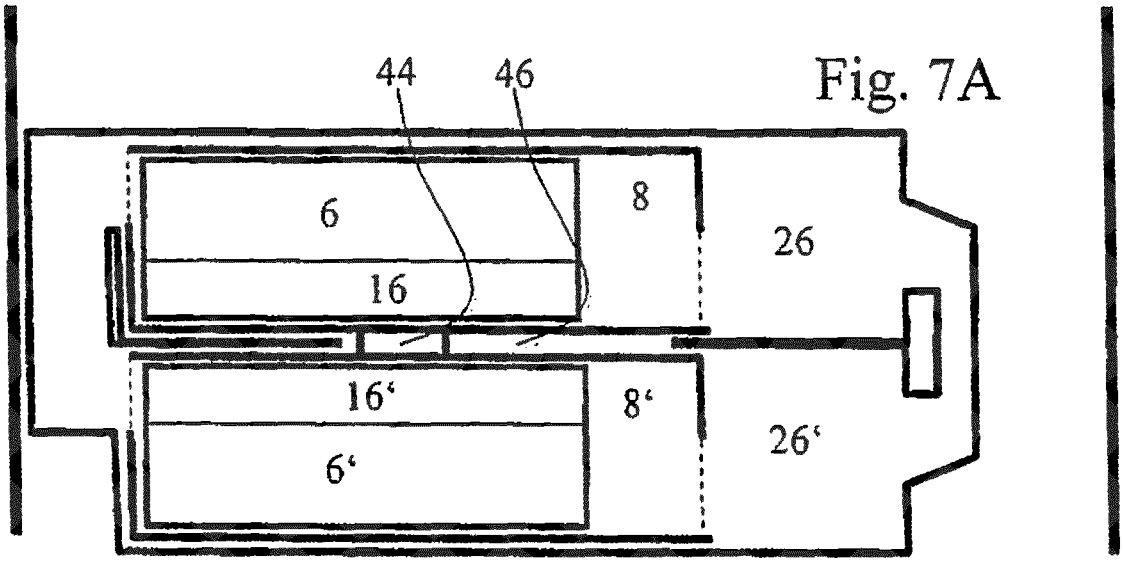
FIGS. 7A and 7B show two combined and cooperating inertial pumps which operate together in a cooling circuit.
Figure 7B:
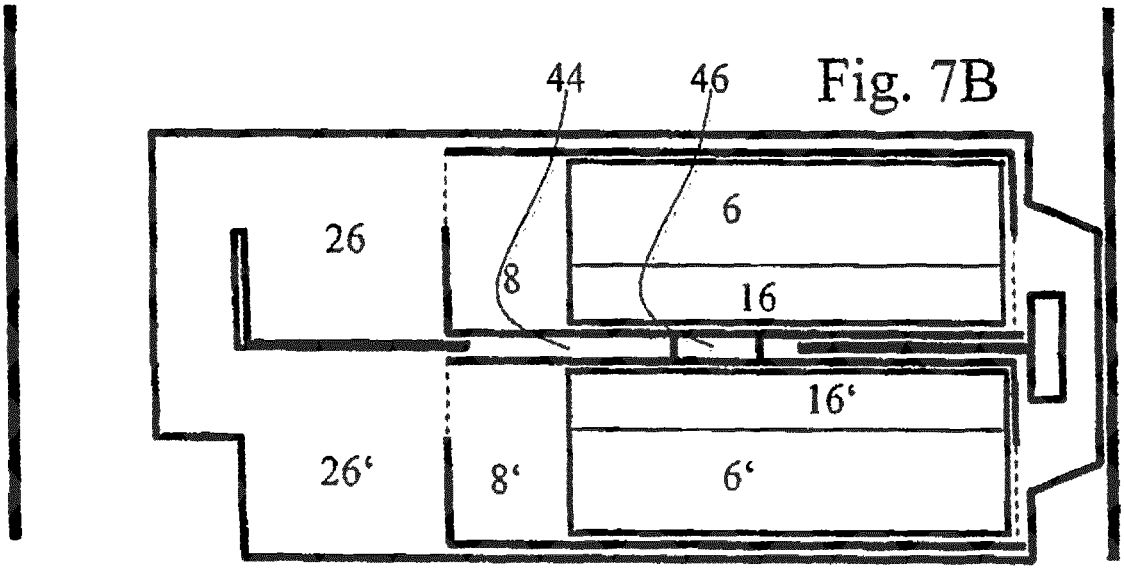

FIG. 6 shows a further development of the double pump from FIGS. 5A and 5B. The upper first and the lower second inertial pump 4, 4' operate in a common cooling circuit. The control bodies can even be connected to one another, as is shown hereinafter for example in FIG. 8B. In this case, a separating or guide element can separate the two liquid paths or pump parts from one another. Otherwise, the same pump bodies as described hereinbefore can be used. The function of the inertial pumps 4 and 4' corresponds to those as described in FIGS. 3A to 5B. The control bodies 8, 8' can here be connected to one another in one plane which lies above or below the plane of the drawing. The double pump according to FIG. 6 here has the advantage that the function of the two partial pumps or the first and the second inertial pump 4, 4' are coupled to one another. Here also the operating mode is the same as has already been described with reference to FIGS. 3A to 5B. FIGS. 7A and 7B also show a possible further development of the double pump from FIGS. 5A and 5B. The upper first and the lower second inertial pump operate in a common cooling circuit. The separating element between the individual pumps has a coupling recess 44. The coupling recess is in this case simply a slit-shaped opening which connects the two cavities 26, 26' of the first and the second pump to one another. Furthermore, the control bodies 8, 8' are connected to one another with a coupling element 46. Instead of a first and a second control body 8, 8', only a single composite or double control body is used here. The double control body is here further designated as 8, 8'. The double control body has the result that both control bodies move synchronously with one another which gives reason to expect an improved function of the double pump. It can also be provided to couple the pump bodies 6, 6' in a similar manner, which however requires a somewhat more complex structure, wherein further boundary conditions are obtained for the working strokes of the control and pump bodies and the length of the pump housing.

FIGS. 8A to 8H show perspective views of individual parts of a double-acting inertial pump and a partial sectional view of a poppet valve with a corresponding inertial pump.

FIG. 8A shows a perspective view of two pump bodies 6, 6'. The pump bodies 6, 6' are designed as semi-cylinders and have an axial recess 16. The pump bodies 6, 6' are further provided with frictional engagement elements 10 which serve to coordinate a movement of the pump bodies 6, 6' with respect to the control body 8. In principle, the pump bodies 6, 6' correspond to those shown in the other figures.

FIG. 8BB shows a perspective view of a double control body 8. The body comprises two end disks which are connected by a central plane. The form of the double control body 8 corresponds to a coil or a circular section of a double-T carrier. The double control body 8 comprises two receiving regions for the pump body of FIG. 8A in each case. The end disks are provided with an opening per receiving region, wherein respectively one is aligned with the respective axial recess and the other can be closed by the respective pump body 6. The one double control body is rotationally symmetrical and point-symmetrical. The control body further comprises a longitudinal recess to receive a guide plate.

FIG. 8C shows a cylindrical housing for the double inertial pump. The housing is thereby formed by a tube which is provided with feet on an underside. The pump bodies 6, 6' can be inserted in the receiving regions of the double control body and these assemblies can then be inserted into the tube or the housing. The pump would in each case pump a cooling fluid from one side to the other and in each case in the axial direction through the tubular housing.

FIG. 8D shows a perspective view of a guide plate or guide body which is guided into the inertial pump on one side, more precisely through the housing and through a corresponding recess in the control body. The guide body extends far out from the pump housing and has a recess at an upper end. The guide body should be inserted into an axial bore in a valve stem and divide the single bore into a separate flow and return channel in the stem. A recess at the upper end enables the cooling fluid to flow from an inlet to a return.

Figure 8E:
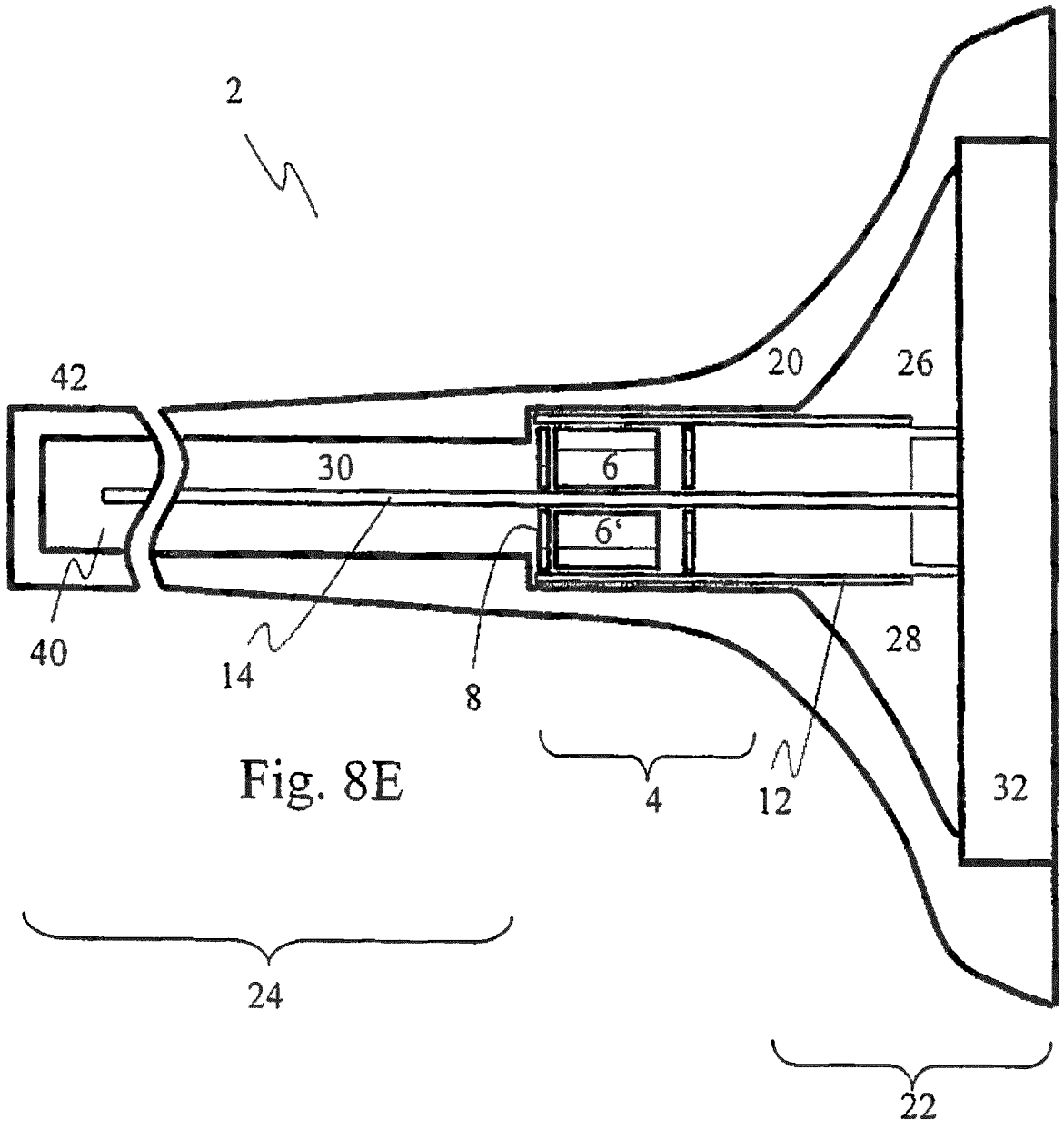

FIG. 8E shows a sectional partial view of an internally cooled valve 2 with a double inertial pump 4 which is composed of parts which are shown in FIGS. 8A to 8D. The function of the inertial pump corresponds to that shown in FIGS. 5A and 5B.

The poppet valve 2 comprises a valve body 20 with a valve head 22. The valve body is provided with a cavity which extends from the valve head 22 into the valve stem end 42. The cavity is closed by a separate valve base 32. The cavity comprises a bore which runs in the valve shaft. Further a cylindrical recess is provided into which the inertial pump 4 or the housing 12 is inserted. The control body 8 is arranged in the housing wherein two receiving regions are provided in the control body into which a first and a second pump body are inserted. The pump bodies are additionally provided with frictional engagement elements in order to prevent these being set in motion in the case of normal motor vibrations. The frictional engagement elements 10 can be designed as leaf springs. The frictional engagement elements 10 are provided to ensure a corresponding mutual movement of the pump body 6 and the control body 8. A guide body runs further through the control body 8 and in the stem bore, which guides the cooling fluid conveyed or pumped by the inertial pump as far as the stem end and returns it again through a recess on another side. It can thus be ensured that the cooling fluid reaches a minimal temperature before it is pumped back into the valve head again. The pump housing is open at a lower end in order to guide the cooling fluid into the valve head, FIG. 8E shows only one of the possible embodiments of an internally cooled valve with inertial pump.

Figures 8F, 8G, 8H:
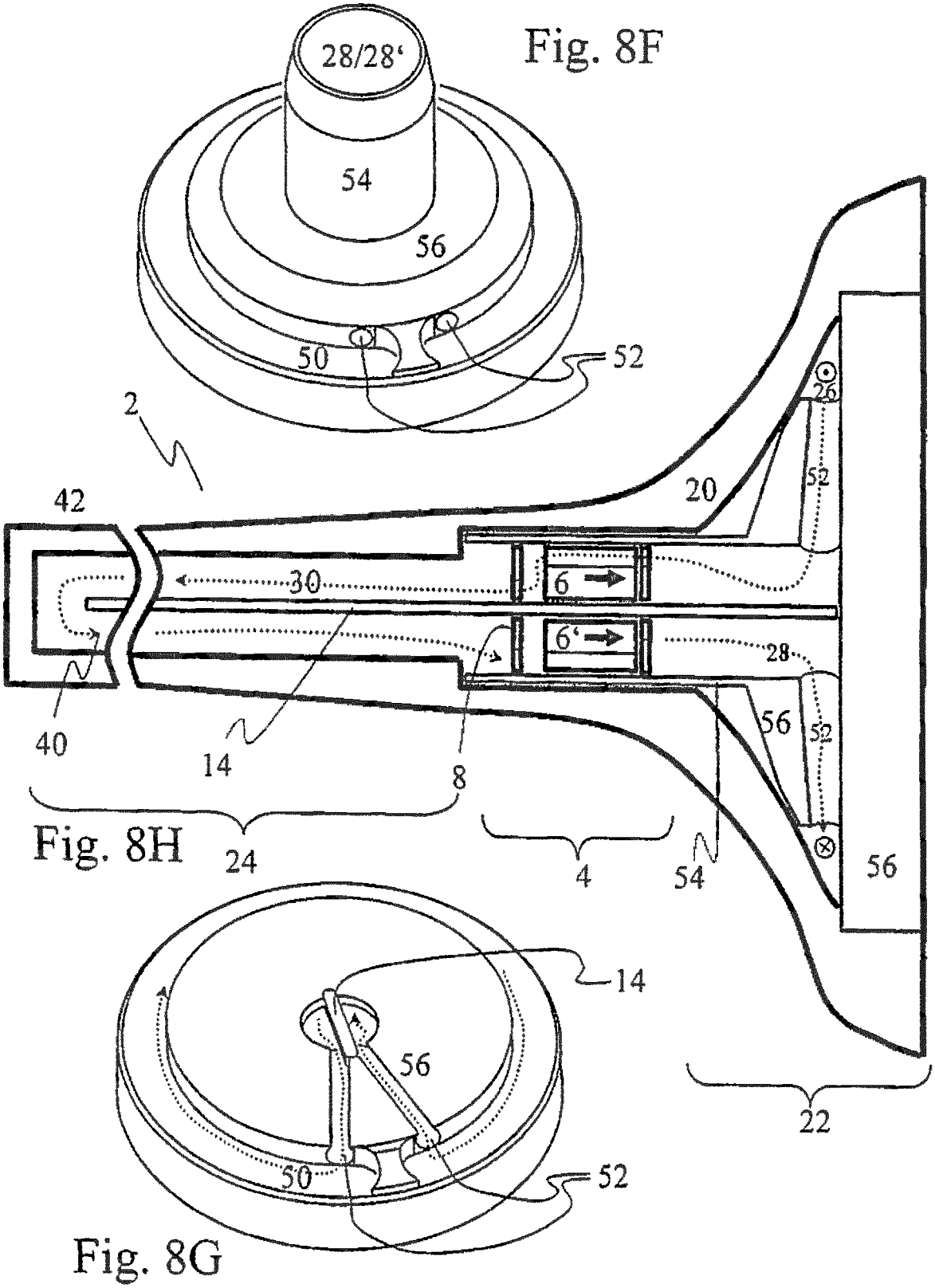

FIGS. 8F to 8H relate to an internally cooled valve with a double inertial pump which have a special cooling of the sealing surface or the valve seat of the valve disk. In this case, a cooling channel running in the circumferential direction is arranged in the region of the edge of the valve disk. FIG. 8F shows a perspective view of a valve base which can be used in this embodiment. FIG. 8G shows a partial sectional view of the valve base from FIG. 8F which can be used in this embodiment. FIG. 8H shows a sectional view through a valve in which the valve base from FIG. 8F is used.

FIG. 8F shows a valve base 56 which is intended to close a cavity of a valve body which extends from a valve head to a valve stem end. The valve base 56 in this case comprises a pump housing or housing 54 of a double inertial pump. A suitable double inertial pump is then inserted into the cavity 28, 28' as shown in the preceding figures. The cavity 28, 28' in the housing 54 is provided with radial bores 52. The radial bores connect a lower end of the double pump to a circumferential cooling path 50 at the edge, which is designed here as a cooling channel. The channel which is open at the top is in this case covered or closed from above by a corresponding inner surface of the cavity 26 in the valve body. The radially outer openings of the radial bores 52 lie relatively close to one another. In order to avoid a coolant short circuit, a separating element is arranged between the outer openings of the radial bores 52 which forces the coolant onto a long path around the entire valve disk. The structure and the operating mode will become clearer from the sectional view of FIG. 8G.

FIG. 8G shows a sectional view of the valve base 56 from FIG. 8F. In the section the course of the radial bores 52 can be clearly identified. Furthermore, another part of a guide body or guide plate 14 can be identified which separates an intake side from a pump side of the double inertial pump in the housing. The dotted arrows indicate the direction of flow of the coolant in the circumferential cooling path 50.

The valve base 56 can also be designed so that the two radial bores 52 are offset with respect to one another by 180°, wherein the cooling path no longer requires a separating element and the coolant can flow in each case 180° in the clockwise or anticlockwise direction at the edge of the valve disk from the first radial bore 52 to the second radial bore 52.

FIG. 8H shows a partial sectional view of an internally cooled valve 2 with a double inertial pump 4 which is composed of the parts shown for example in FIGS. 8A, 8B, 8D and for example 8F. The poppet valve 2 from FIG. 8H comprises a valve body 20 with a valve head 22. The valve body is provided with a cavity which extends from the valve head 22 as far as into the valve stem 24. The cavity is closed by a separate valve base 56. The cavity comprises a bore which runs in the valve stem. The cavity is in this case closed by a valve base 56 which comprises the housing 54 for a double inertial pump 4 as well as a circumferential cooling channel 50.

The control body 8 is arranged in the housing of the valve base 56, wherein two receiving regions are provided in the control body into which a first and a second pump body 6, 6' are inserted. The pump bodies 6, 6' are additionally provided with frictional engagement elements in order to prevent these starting to move under normal motor vibrations. The frictional engagement elements 10 can be designed as leaf springs. The frictional engagement elements 10 are provided to ensure a corresponding mutual movement of the pump body 6 and the control body 8. Furthermore a guide body runs through the control body 8 and into the stem bore, which guide body guides the cooling fluid conveyed or pumped by the inertial pump as far as the stem end and returns it again through a recess on the other side. The guide body 14 should also separate the first inertial pump from the second inertial pump in order to avoid a flow short circuit. As a result of the long first cooling circuit 30 up to the valve stem end 42, it can be ensured that the cooling fluid reaches a minimal temperature before it is pumped back into the valve head again. The pump housing 54 has two radial bores 52 at one lower end in order to guide the cooling fluid into a circumferential cooling path 50 at the edge of the valve head 22. FIG. 8H shows one embodiment in which the radial bores are offset by 180° with respect to one another so that a part of the cooling fluid 28 is pumped in the clockwise direction and another part of the cooling fluid is pumped in the anticlockwise direction through the circumferential cooling path 50. The function of the inertial pump also corresponds to that shown in FIGS. 3A to 5B.

REFERENCE LIST

2 Poppet valve
4 Inertial pump
6 Pump body/first pump body
6' Second pump body
8 Control body/first control body
8' Second control body
10 Frictional engagement element
10' Second frictional engagement element
12 Inertial pump housing
14 Guide body
20 Valve body
22 Valve head
24 Valve stem
26 Cavity
28 Cooling fluid
30 Closed cooling circuit/first 30 closed cooling circuit
30' Second closed cooling circuit
32 Valve base
40 Bore
42 Valve stem end
44 Coupling recess
46 Coupling web
50 Circumferential cooling path
52 Radial bore
56 Inertial pump housing of valve base
58 Valve base with inertial pump housing and radial bore and circumferential cooling path
AP Working stroke of pump body
AS Working stroke of control body
AV Working stroke of valve

The invention claimed is:

1. An internally cooled poppet valve, comprising:

a valve body having a valve head and a valve stem, wherein the valve body comprises a closed cavity in which a cooling fluid is disposed, the valve body including an inertial pump disposed therein and operative to move the cooling fluid within the closed cavity, wherein the inertial pump comprises at least one pump body and at least one control body configured to control an intake and/or a discharge of the cooling fluid to or from the at least one pump body, the at least one pump body and the at least one control body configured to move within the closed cavity; and wherein the at least one pump body has a working stroke (AP) that is greater than a working stroke (AS) of the at least one control body.

2. The internally cooled poppet valve according to claim 1, wherein the closed cavity forms at least one closed circuit.

3. The internally cooled poppet valve according to claim 1, wherein the cooling fluid is compressible.

4. The internally cooled poppet valve according to claim 1, wherein the cooling fluid is incompressible.

5. The internally cooled poppet valve according to claim 1, wherein the at least one pump body is disposed within the at least one control body.

6. The internally cooled poppet valve according to claim 5, wherein a frictional engagement element is disposed on the inertial pump and configured to place the at least one pump body in frictional engagement with the at least one control body.

7. An internally cooled poppet valve, comprising:

a valve body having a valve head and a valve stem, wherein the valve body comprises a closed cavity in which a cooling fluid is disposed, the valve body including an inertial pump disposed therein and configured to move the cooling fluid within the closed cavity during operation, wherein the inertial pump comprises at least one pump body, wherein the inertial pump further comprises at least one control body configured to control an intake/discharge of the cooling fluid to or from the at least one pump body, and wherein the at least one pump body has a working stroke that is greater than a working stroke of the at least one control body.

8. The internally cooled poppet valve according to claim 1, wherein the valve body and/or the at least one pump body and/or the at least one control body comprises a valve in a path of the cooling fluid.

9. The internally cooled popped valve according to claim 1, wherein the closed cavity of the valve body partially forms a bore in the valve stem, and wherein a guide body is inserted into the bore such that a cooling circuit extends from the valve head to an opposite end of the valve stem and back again.

10. An internally cooled poppet valve, comprising:

a valve body having a valve head and a valve stem, wherein the valve body comprises a closed cavity in which a cooling fluid is disposed, the valve body including an inertial pump disposed therein and operative to move the cooling fluid within the closed cavity, wherein the inertial pump comprises at least one pump body, wherein the inertial pump further comprises at least one control body configured to control an intake/discharge of the cooling fluid to or from the at least one pump body, and wherein the at least one pump body comprises two pump bodies, including a first pump body and a second pump body; and the at least one control body comprises two control bodies, wherein the first pump body is configured to execute a first working stroke during a valve closing process, and the second pump body is configured to execute a second working stroke during a valve opening process.

11. The internally cooled poppet valve according to claim 10, wherein one or both of the two pump bodies has a circular cylinder shape with an axial recess, or both of the two pump bodies has a semi-circular cylinder shape with an axial recess; and wherein at least one of the two control bodies is coil-shaped or half-coil shaped.

12. The internally cooled poppet valve according to claim 1, wherein the poppet valve is provided with an inertial pump housing, a circumferential cooling path, and radial bores that connect the inertial pump housing to the circumferential cooling path, the inertial pump housing, circumferential cooling path, and radial bores provided at a valve base of said poppet valve.

* * * * *